US008231370B2

(12) United States Patent
Maas et al.

(10) Patent No.: US 8,231,370 B2
(45) Date of Patent: Jul. 31, 2012

(54) APPARATUS AND METHOD FOR DEPOSITING SYNTHETIC FIBERS TO FORM A NON-WOVEN WEB

(75) Inventors: Lutz Maas, Wahlstedt (DE); Henning Rave, Achterwehr (DE); Wiley Scott Harris, Pompano Beach, FL (US)

(73) Assignee: Oerlikon Textile GmbH & Co. KG., Remscheid (DE)

( * ) Notice: Subject to any disclaimer, the term of this patent is extended or adjusted under 35 U.S.C. 154(b) by 46 days.

(21) Appl. No.: 12/494,475

(22) Filed: Jun. 30, 2009

(65) Prior Publication Data

US 2009/0321982 A1 Dec. 31, 2009

Related U.S. Application Data

(63) Continuation of application No. PCT/EP2008/050522, filed on Jan. 17, 2008.

(30) Foreign Application Priority Data

Jan. 19, 2007 (DE) ..... 10 2007 002 956

(51) Int. Cl.
*D01D 5/098* (2006.01)
*D04H 1/732* (2012.01)

(52) U.S. Cl. ..... 425/66; 425/72.2; 425/83.1

(58) Field of Classification Search ..... 425/66, 425/72.2, 83.1
See application file for complete search history.

(56) References Cited

U.S. PATENT DOCUMENTS

| | | | | | |
|---|---|---|---|---|---|
| 3,611,508 | A * | 10/1971 | Reinhall et al. | ..... | 264/518 |
| 3,929,542 | A * | 12/1975 | Gehrig et al. | ..... | 156/167 |
| 4,627,811 | A * | 12/1986 | Greiser et al. | ..... | 425/72.2 |
| 4,820,459 | A * | 4/1989 | Reifenhauser | ..... | 264/40.3 |
| 4,964,197 | A * | 10/1990 | Mente et al. | ..... | 19/299 |
| 5,336,071 | A * | 8/1994 | Kobayashi et al. | ..... | 425/66 |
| 5,460,500 | A * | 10/1995 | Geus et al. | ..... | 425/66 |
| 5,814,349 | A * | 9/1998 | Geus et al. | ..... | 425/66 |
| 6,338,814 | B1 * | 1/2002 | Hills | ..... | 264/510 |
| 6,402,492 | B1 * | 6/2002 | Achterwinter et al. | ..... | 425/72.2 |
| 6,824,717 | B2 | 11/2004 | Schafer | | |
| 6,979,186 | B2 * | 12/2005 | Schmit et al. | ..... | 425/72.2 |
| 2006/0000070 | A1 | 1/2006 | Mooshammer | | |

* cited by examiner

*Primary Examiner* — Yogendra Gupta
*Assistant Examiner* — Joseph Leyson
(74) *Attorney, Agent, or Firm* — BainwoodHuang

(57) ABSTRACT

An apparatus and method for depositing synthetic fibers to form a non-woven web includes guiding the synthetic fibers by a blowing stream through a drawing unit for depositing on a deposit belt. Multiple guidance elements are arranged inside the guidance distance between a blast opening of the drawing unit and the deposit belt, and form a guidance channel above the deposit belt. The guidance elements form a channel opening at a distance from the blast opening of the drawing unit. In order to achieve constant strength in the deposition of the fiber strands, the distance between the outlet of the drawing unit and the channel opening of the guidance channel is larger than half the guidance distance, and the guidance width of an open space formed between the outlet of the drawing unit and the channel opening of the guidance channel is larger than the guidance channel.

19 Claims, 5 Drawing Sheets

APPARATUS AND METHOD FOR DEPOSITING SYNTHETIC FIBERS TO FORM A NON-WOVEN WEB

CROSS REFERENCE TO RELATED APPLICATIONS

This Patent application is a Continuation of International Patent Application No. PCT/EP2008/050522 filed on Jan. 17, 2008, entitled, "APPARATUS AND METHOD FOR DEPOSITING SYNTHETIC FIBERS TO FORM A NON-WOVEN WEB", the contents and teachings of which are hereby incorporated by reference in their entirety, which claims foreign priority to DE 10 2007 002 956.1 filed on Jan. 19, 2007.

TECHNICAL FIELD

The invention relates to an apparatus for depositing synthetic fibers to form a non-woven web and a method for depositing a plurality of fibers to form a non-woven web.

BACKGROUND

When producing a non-woven web of synthetic fibers, a plurality of extruded fiber strands have to be deposited as evenly as possible to form a textile fabric. The fiber strands are drawn off using a feed fluid, more or less after the extrusion and cool-down processes, and are guided to a deposit belt. The distribution of the fibers on the deposit belt is preferably desired to be such that the non-woven web formed therefrom has uniform strength both in the machine direction (MD) and in the cross direction (CD). For controlling the deposition of the fibers, it is known to insert guidance elements in the region of a guidance distance, which can be adjusted between the draw-off nozzle and the deposit belt. Guidance elements of this type influence the guidance of the fibers up to their deposition on the surface of the deposit belt.

Thus, for example, an apparatus and a method are disclosed in the European Patent Specification EP 1 138 813 A1, in which method the guidance elements are designed as side walls and are arranged to form a guidance channel, which expands in a V-shaped manner towards the deposit belt. Between the guidance channel and the drawing unit there is an open space, the linear extension of which is selected such that the air blasts discharged from the draw-off nozzles can enter into the opening of the guidance channel in a substantially straight manner. The fibers are guided through the guidance channel for stretching and depositing them on the deposit belt, the depositing pattern of the fibers being determined by the shape and the air conduction inside the guidance channel. Thus, this method results in uniform deposit ellipses of the fibers on the surface of the deposit belt. Irregularities can develop in the non-woven web in the form of lumps due to large deflections of the filament curtain in the machine direction.

The apparatus disclosed in EP 1 138 813 B1 relates to a so-called melt-blown process in which the freshly extruded fibers are drawn off immediately by a hot air blast of the drawing unit discharged from the nozzle capillary. For the purpose of cooling the fibers, the latter are thus initially guided immediately through an open space in which the ambient air can be used for cooling the fibers. In order to achieve a thorough stretching of the fiber strands, the guidance distance from the drawing unit up to the deposit belt is substantially determined by the guidance channel.

If the fibers are initially cooled down after the melt-spinning and are received in the solid state through a drawing unit, and are blown for being deposited on the deposit belt, the guidance channel can be formed by the guidance elements over the entire length of the guidance distance. An apparatus of this type is disclosed in EP 1 340 842 A1 by way of example. Here, the fibers are guided inside the guidance distance through several guidance elements arranged to form a guidance channel. The guidance channel comprises several channel constrictions, which create a diffuser effect. Diffusers of this type lead to a restriction of the mobility of the fibers with the result that relatively small deposit ellipsis of the fiber strands are formed on the surface of the deposit belt. In order to, in spite of this, create the most uniform non-woven web possible, the exhaust equipment disposed beneath the deposit belt includes several sections for the purpose of discharging the air blast, thereby ensuring that the fibers rest on the deposit belt in a stable manner. However, such a measure enables only a small degree of control over the guidance of the fibers up to their deposition on the surface of the deposit belt. In this respect, it is thus only possible to achieve fiber deposits with relatively small deposit ellipses. Another disadvantage of closed systems of this type is that due to the guided flow, it is necessary to maintain longer stretching zones and thus larger distances between the draw-off nozzle and the deposit belt.

In order to control the deposit of the synthetic fibers on the deposit belt, it is further known to arrange a guidance elements in the open space formed between the draw-off nozzle and the deposit belt wherein the guidance elements can be used to change the fiber stream for the purpose of controlling the deposition of the fibers. An apparatus of this type is disclosed in US 2002/0158362 A1 by way of example. The guidance elements are held at a large distance from the deposit belt in order to create an air swirl for forming a traversing movement of the fibers. Although this helps achieve special effects in the deposit of the non-woven web, this apparatus greatly loses its effectiveness at higher production speeds.

SUMMARY

An apparatus and a method for depositing synthetic fibers to form a non-woven web of the generic type is provided which deposits the fibers in a uniform and controlled fashion to form a non-woven web with very uniform strength in the machine direction and in the cross direction even at higher spinning speeds.

In one embodiment, the apparatus and method deposits synthetic fibers to form a non-woven web to such effect that a non-woven web can be created on the deposit belt, the non-woven web having uniform thickness even in the case of a lighter basis weight.

The invention is based on the realization that the manner in which the fibers are deposited on the surface of the deposit belt in the case of an open system is substantially determined by the size of the guidance distance adjusted between the blast opening of the draw-off nozzle and the deposit belt. The following rule applies here: The larger the guidance distance, the larger the deposit ellipses resulting from the fibers during their deposition on the surface of the deposit belt, both in the machine direction and in the cross direction. However, large deposit ellipses also involve the risk of irregularities in the formation of the thickness of the non-woven web. For adjusting constant thickness over the entire width and length of the non-woven web, it is necessary to realize small deposit ellipses particularly during the deposit of the fibers. It is here that the invention steps in, by providing that the fibers be initially blown out in an open space over a relatively large guidance path. Accordingly, a higher mobility of the fibers is possible which would lead to the corresponding large deposit ellipses. Before the fibers impinge on the deposit belt, they are introduced using the guidance elements into a guide channel, which leads to a restriction of the mobility of the fibers in the machine direction. In particular, the restriction of the deposit ellipse in the machine direction brings about constancy in the properties of the non-woven web. Thus it is possible to deposit the fibers on the surface of the deposit belt so as to achieve the optimum strength and thickness of the non-woven web. For this purpose the distance between the outlet of the drawing unit and the opening of the guidance channel is larger than half the guidance distance so as to provide the fibers with sufficiently high mobility before they enter into the guidance channel. The guidance width of the open space formed between the outlet of the drawing unit and the opening of the guidance channel is larger than the width of the guidance channel.

For the purpose of improving the guidance of the fibers inside the guidance distance particularly at high speeds, it is further suggested to provide the opening of the guidance channel with the most convergent design possible by arranging or forming guidance elements such that the channel opening opens out into a constriction of the guidance channel. Thus, the restriction of the mobility of the fibers is achieved by a funnel-shaped partial distance having increasing constriction so as to provide a secure entry of the fibers into the guidance channel.

It has proved to be particularly advantageous for creating non-woven webs having light basis weights if the guidance width of the open space is at least five times larger than that of the constriction of the guidance channel. It is thus possible to achieve a high degree of uniformity even if the non-woven web has less thickness.

For this purpose, the width of the constriction of the guidance channel is in the range of 10 mm to 200 mm, wherein the guidance channel receives a constant expansion of the channel constriction preferably toward the deposit belt. Thus it is possible to achieve expansions of the fiber bundles at a short distance from the deposit belt, thereby showing further improvement in the uniformity of the deposition of the non-woven web.

The length of the guidance distance between the blast opening of the drawing unit and the deposit belt is preferably in a range of 100 mm to 700 mm. Thus the desired forms of fiber depositions can be realized depending on the yarn count and polymer type.

According to one embodiment of the invention, in order to prevent exchange processes with the ambience, the open space on the supply side of the belt and on the discharge side of the belt is shielded from the ambience by walls. In order to compensate for pressure differences resulting on the outlet side of the draw-off nozzle in spite of such a closed system, the walls have several ports for suctioning ambient air below the blast opening of the drawing unit. It is thus possible, even with a closed system, to create non-woven webs having increased strength and at the same time high uniformity in the distribution of the fibers.

However, it is also possible to use the ports in the walls for actively blowing in secondary air. This helps achieve additional effects when guiding the fibers.

In order to prevent an impermissible control of the deposit situation of the fibers and the guidance of the non-woven web on the deposit belt, particularly in the case of light basis weights of the non-woven web and short guidance distances, the ports are coupled by an air intake channel to a suction inlet having an inlet opening that is turned away from the deposit belt. It is thus possible for the ambient air to be suctioned from zones that are not critical for the deposition of the non-woven web on the deposit belt.

For designing the guidance channel, the guidance elements can be provided with any design and shape. One embodiment that has proved to be particularly advantageous is one in which the guidance elements are each designed at both the sides by a moulded thin sheet, wherein the thin sheets cooperate with the deposit belt and the non-woven web for sealing the guidance channel. It is thus possible to realize particularly random shapes of the guidance channel and the channel opening in order to achieve the desired guidance of the fibers.

In one embodiment, one clamping end of the molded thin sheet is fixed in the region of the channel opening while a deformation end is held flexibly in the region outside the guidance channel. By moving the deformation end relative to the clamping end, it is thus possible to vary the shape of the respective thin sheet. Here, the thin sheet is preferably held such that it contacts the deposit belt or the non-woven web.

For sealing the guidance channel, the guidance elements are preferably designed in such a way that an oblong sealing gap is designed between the deposit belt or the non-woven web and the guidance elements. It is thus possible to prevent a grinding contact between the deposit belt and, for example, a thin sheet designed as a guidance element and also between the non-woven web and the thin sheet. The deposit region is sealed over the length and height of the sealing gap alone. For this purpose the guidance elements can also be formed, for example, by solid structural elements, which form a milled or molded profile of the guidance channel.

Alternatively, another embodiment has also proved to be advantageous in which the guidance elements arranged on the discharge side of the belt is formed by a pivoted roller which could form a forming gap for the non-woven web with the deposit belt, for example. This helps ensure a high impermeability of the guidance channel in relation to the ambience.

The guidance elements arranged on the supply side of the belt can likewise be designed preferably as a pivoted roller, which is held such that it contacts the deposit belt.

Another embodiment that is advantageous for sealing the guidance channel is one in which the rollers each have a resilient roller jacket. A soft material such as an elastomer wound around a hard core can form the resilient roller jacket, for example. However, it is also possible to form the roller using a sheet metal jacket guided on the surface of the deposit belt.

The use of the device disclosed herein can be improved particularly by assigning a height-adjusting device to the guidance elements and/or to the deposit belt according to one embodiment. The height adjusting device can be used to change the length of the guidance distance and/or the height of the forming gap between the guidance elements and the deposit belt.

It is further suggested to design at least one of the guidance elements such that it can be displaced transversely to the drawing unit so as to be able to adjust the width of the guidance channel, particularly the size of the channel constriction.

In order to continuously absorb and discharge the air quantity supplied by the draw-off nozzle, an adjustable exhaust port is designed below the deposit belt, whereby an exhaust port of exhaust equipment is connected to the lower side of the deposit belt. In doing so, the size of the exhaust port can be changed between two covering surfaces held such that they can be displaced in relation to one another so as to absorb and discharge the feed fluid optimally and uniformly depending on the deposition of the fibers.

Since in the case of rapid processes and greater differences in the width of the open space and that of the channel constriction, there exists the risk of the fibers hitting the guidance elements during their entry into the guidance channel, in one embodiment several electrical charge inducers are provided in order to create a positive charge on the fibers and on the guidance elements. This helps support the movement of the fibers toward their entry into the guidance channel. The like polarization charges of the fibers and the guidance elements prevent the adhesion of the fibers to the surfaces of the guidance elements and support the entry of the fibers into the guidance channel.

The method for depositing a plurality of fibers to form a non-woven web combines the special advantages of an open system in which the fiber stream is blown out immediately into an open space, with those of a controlled, reproducible and secure deposition of the fibers to form a non-woven web. In spite of the open system, ambient influences caused, for example, by external air are reduced to a minimum during the deposition of the fibers. However, the method according to the invention is also advantageously applicable in closed systems in order to create the fibers to form a non-woven web with uniform strength and thickness in the machine direction and cross direction.

The apparatus and the method disclosed herein are distinguished by a stable and reproducible deposition of the fibers to form a non-woven web with high uniformity, where both high spinning and production speeds are possible. The invention is applicable both for producing so-called spun-bond and melt-blown non-woven webs. Here, the fiber material and non-woven requirement can be selected in any desired setting depending on the fiber type.

BRIEF DESCRIPTION OF THE DRAWINGS

In the following, embodiments of the invention will be explained in more detail with the aid of several examples of the device. The apparatus according to the invention and the method according to the invention will be described in detail below on the basis of some example embodiments and with reference to the attached figures, of which.

DETAILED DESCRIPTION

Figure 1:
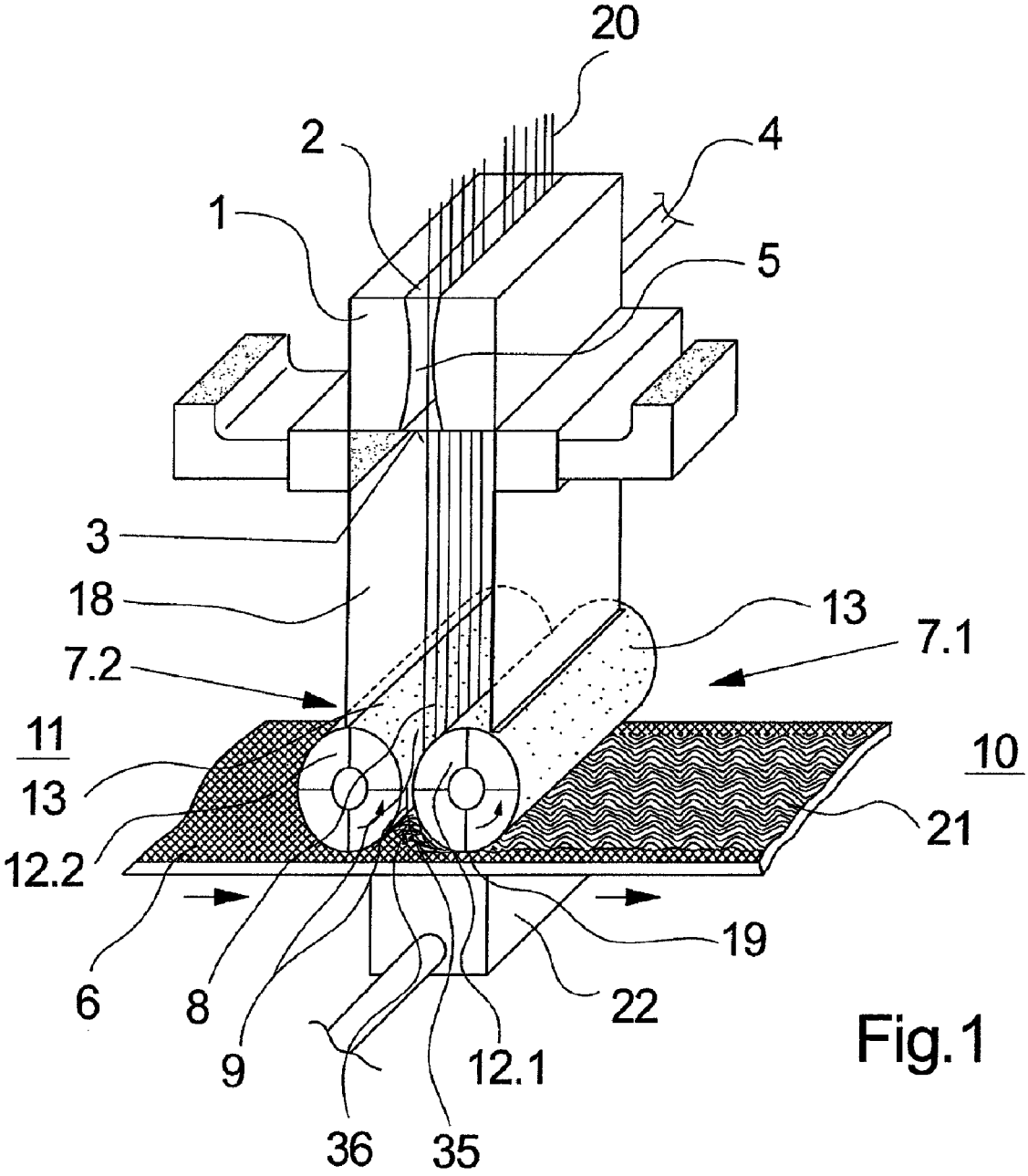
FIG. 1 schematically shows a view of a first example embodiment of the apparatus according to the invention.
Figure 2:
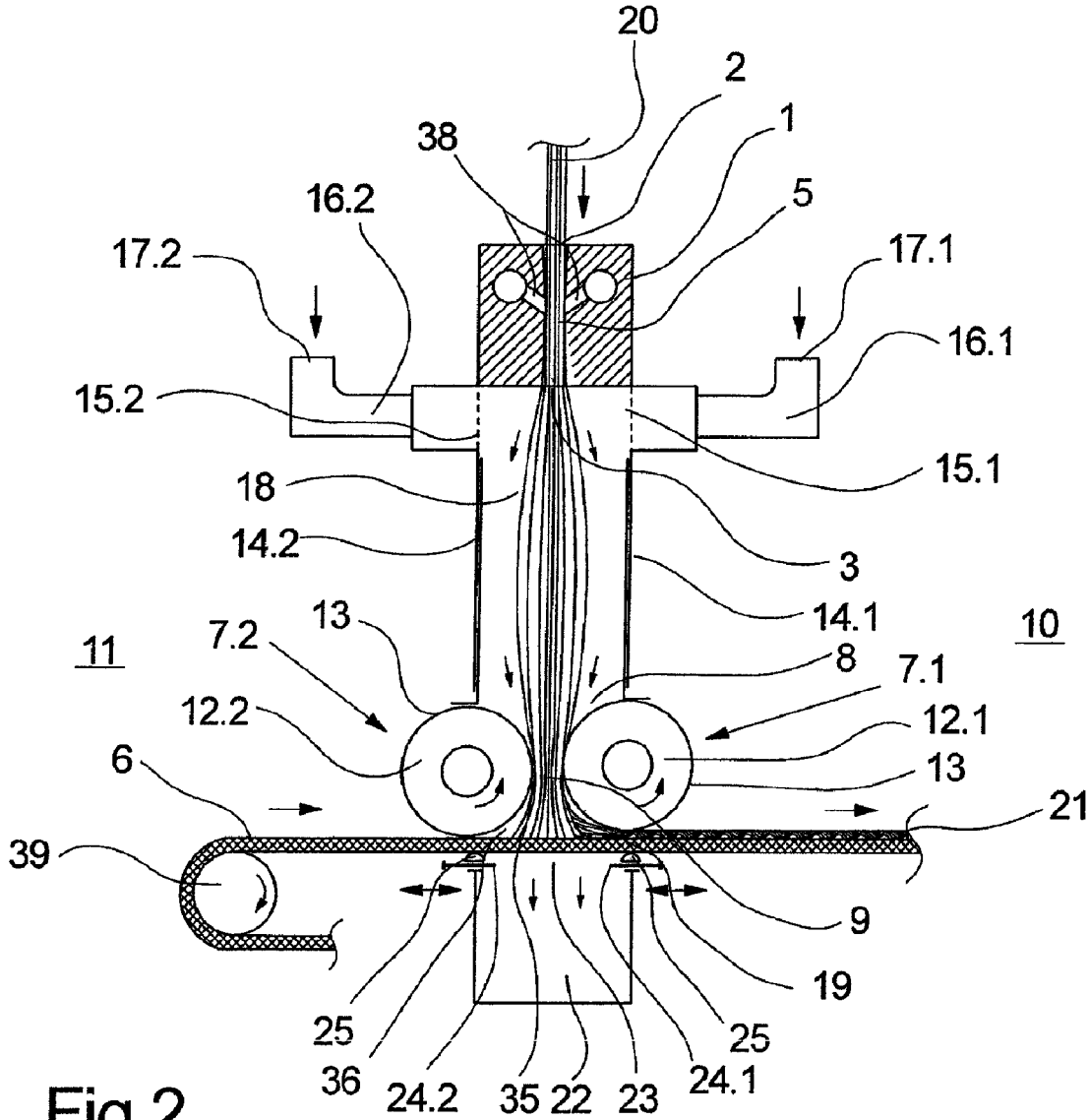
FIG. 2 schematically shows a cross-sectional view of the example embodiment shown in FIG. 1.

FIGS. 1 and 2 schematically show a first example embodiment of the apparatus according for depositing synthetic fibers to form a non-woven web and for implementing the inventive method. FIG. 1 shows a lateral view of the example embodiment while FIG. 2 schematically shows a cross-sectional view thereof. The subsequent description applies to both the figures unless express reference is made to any one of the figures.

The example embodiment shown in FIGS. 1 and 2 shows a parallel-piped drawing unit 1, which is usually arranged below a spinning device. Drawing units of this type are known in general and have been explained in detail in U.S. Pat. No. 6,183,684 B1 and/or U.S. Pat. No. 7,172,398 B2. The contents and teachings of which are hereby incorporated by reference in their entirety.

The drawing unit 1 includes a middle conveying channel 5, which is delimitated on an upper side of the drawing unit 1 by a slot-shaped fiber inlet 2 and on the lower side of the drawing unit 1 by a blast opening 3. The conveying channel 5 is provided with a slot-shaped design and it extends substantially over the overall length of the parallel-piped drawing unit 1. On the longitudinal sides of the conveying channel 5 there are designed several fluid inlets 38 which are connected to a fluid connection 4. A feed fluid, preferably compressed air, is supplied by the fluid connection 4 so as to create an excess pressure in the conveying channel 5 in relation to the ambience.

The drawing unit 1 is arranged at a distance above a deposit belt 6. The width of the deposit belt 6 extends over the entire length of the drawing unit 1. The deposit belt 6 is preferably guided as an endless conveyor over several conveyor rollers 39, one of which is shown in FIG. 2. The deposit belt is driven such that it is directed transversely to the longitudinal side of the drawing unit 1. The deposit belt 6 thus moves continuously in a guidance direction, which is indicated in FIG. 1 and FIG. 2 using arrows. The deposit belt 6 is designed to be permeable to air, wherein exhaust equipment 22 is arranged on the lower side of the deposit belt 6 in a deposit region designed vertically below the drawing unit 1.

The region between the drawing unit 1 and the deposit belt 6 is used for guiding the fiber strands 20 drawn off from the spinning device. The distance between the blast opening 3 on the lower side of the drawing unit 1 and the surface of the deposit belt 6 is referred to as the guidance distance here. The guidance distance is divided into several sections, in order to achieve a defined guidance with respect to a desired position of the fiber strands 20 on the surface of the deposit belt 6. Directly below the drawing unit 1 there is provided an open space 18, which has a large guidance width with the result that the blown air stream discharged together with the fiber strands 20 from the blast opening 3 can be expanded freely. For this purpose, the open space 18 is shielded from the ambience by laterally extending separation walls 14.1 and 14.2. In the upper region of the separation walls 14.1 and 14.2 there are designed several suction ports 15.1 and 15.2, through which external air is suctioned due to the vacuum created by the blowing air stream directly on the lower side of the drawing unit 1. For this purpose the suction port 15.1 in the separation wall 14.1 is coupled to the air intake channel 16.1, which has a suction inlet 17.1 on one free end. The suction inlet 17.1 has an inlet opening, which is directed upwards and is turned away from the deposit belt 6. The suction ports 15.2 of the opposite separation wall 14.2 are likewise connected to an air intake channel 16.2. The air intake channel 16.2 likewise has a suction inlet 17.2 with an upwardly directed suction inlet opening. Particularly in the case of very short guidance distances between the drawing unit 1 and the deposit belt, it is thus possible to prevent an influence exerted over the deposit of the non-woven web due to the suction of external air into the open space 18. Due to the upwardly directed suction inlets 17.1 and 17.2, the external air suctioned by the blowing stream is withdrawn from an ambience, which is not critical for depositing the fibers on the deposit belt 6. Thus it is also possible to select relatively short guidance distances for producing fine and light non-woven webs.

The open space 18 extends over a length, which exceeds at least half the guidance distance. In this respect, the blowing stream expands increasingly with its progressive motion with the result that a correspondingly large mobility of the fiber strands is achieved both in the machine direction of the deposit belt, also referred to as MD in short, and also in a cross direction thereto.

In the further course of the guidance distance, the open space 18 is delimited by the guidance elements 7.1 and 7.2, which form a guidance channel 9 for receiving the blowing stream. For this purpose, one of the guidance elements 7.1 is arranged on a belt discharge side 10 and the second guidance elements 7.2 are arranged on the opposite belt supply side 11. The guidance elements 7.1 and 7.2 are each formed by a pivoted roller 12.1 and 12.2. The guidance channel 9 formed between the guidance elements 7.1 and 7.2 thus essentially includes three sections, which bring about the guidance of the blowing stream in the extension of the open space 18. At the end of the open space 18, the guidance elements 7.1 and 7.2 form a channel opening 8, which opens into a channel constriction 35 convergently. The channel constriction 35 represents the smallest guidance width inside the guidance channel 9. The channel constriction 35 gives way to a divergent channel outlet 36 with the result that the blowing stream expands again after its initial constriction due to a constant expansion of the channel constriction. At the end of the guidance channel 9, the fiber strands 20 are deposited on the deposit belt 6. The deposit region, which represents the end of the guidance channel 9, is shielded from the ambience with a sealing effect by each of the rollers 12.1 and 12.2. The direct frictional contact between the rollers 12.1 and 12.2 and the deposit belt 6 and also the surface of the non-woven web 21 helps achieve a sealing effect from the external air. For this purpose the rollers 12.1 and 12.2 can comprise a resilient roller jacket 13. This helps generate relatively small contact pressing forces, which, for example, prevent the so-called polymer droplets from pressing into the deposit belt when the plant is started up.

The rollers 12.1 and 12.2 are in frictional contact with the deposit belt 6 with the result that the rotational movement of the rollers 12.1 and 12.2 is generated by friction by the conveying movement of the deposit belt 6. Alternatively, each of the rollers 12.1 and 12.2 could also have a separate drive. The roller 12.2 rests directly against the surface of the deposit belt 6 or on a support material. The roller 12.1 on the belt discharge side 10 forms a forming gap 19 with the upper side of the deposit belt 6, through which forming gap the non-woven web 21 can be formed additionally after the deposit of the fiber strands 20.

For implementing and supporting the fiber deposit for forming the non-woven web, the exhaust equipment 22 is disposed on the lower side of the deposit belt 6. The exhaust effect of the exhaust equipment 22 is limited to the deposit region of the guidance channel 9. The exhaust equipment 22 comprises an adjustable exhaust port 23, which is assigned directly to the deposit region on the deposit belt 6. The exhaust port 23 is formed between two mobile cover plates 24.1 and 24.2. Each of the cover plates 24.1 and 24.2 can be moved horizontally relative to one another. For sealing the exhaust port 23, sealing elements 25 are provided on the lower side of the deposit belt 6 so as to prevent external air from entering from the lower side of the deposit belt 6.

Figure 3:
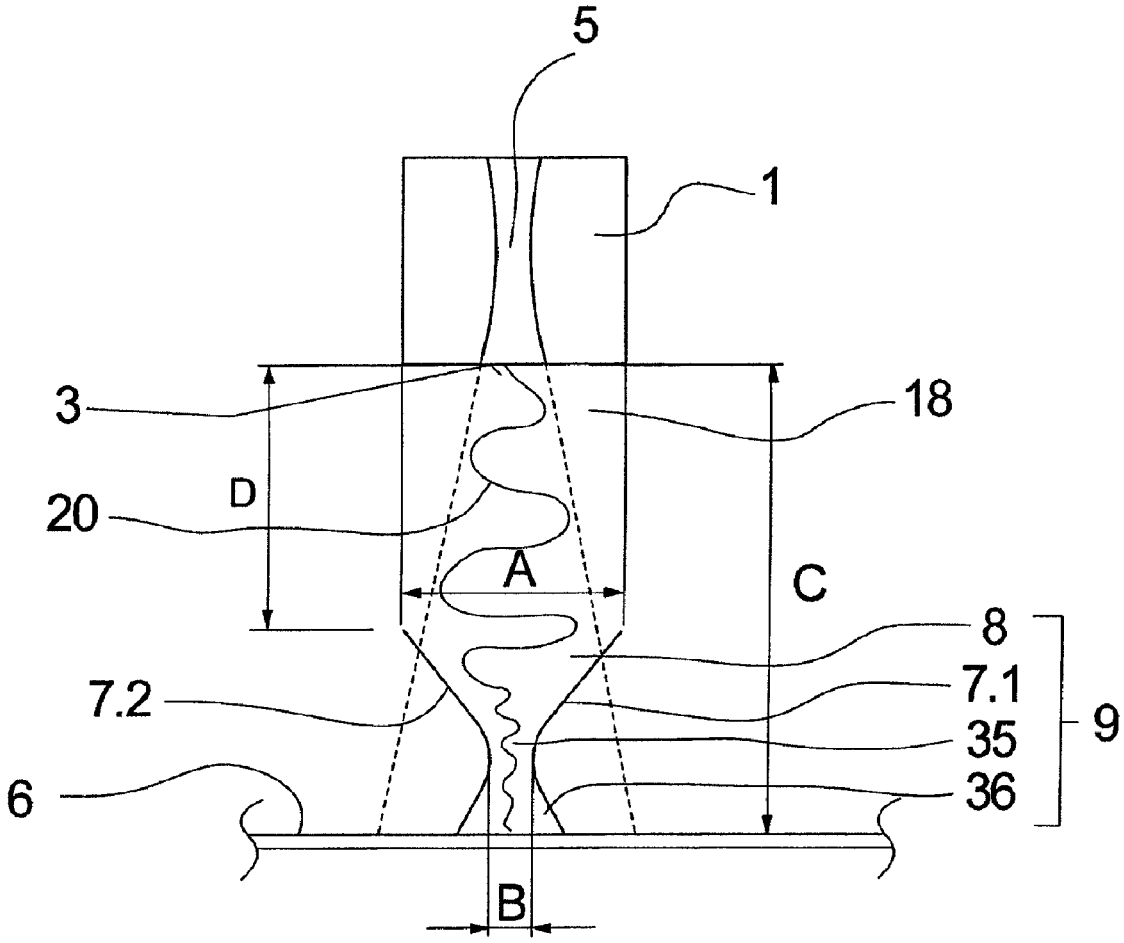
FIG. 3 is a functional diagram of the example embodiment shown in FIGS. 1 and 2.

In order to explain the functioning of the example embodiment shown in FIGS. 1 and 2, and the method implemented by the embodiment, reference will now be made to the schematic diagram shown in FIG. 3. FIG. 3 shows the guidance distance formed between the drawing unit 1 and the deposit belt 6 with its sub-sections. The guidance distance, which is marked with the capital letter C, can basically be divided initially into two sub-sections. A first sub-section extends from the lower side of the drawing unit 1 up to the upper side of the guidance elements 7.1, 7.2 and represents the length of the open space 18. This section of the guidance distance is marked with the capital letter D. The open space 18 formed in this section D of the guidance distance has a relatively large guidance width marked with the capital letter A. The guidance width A of the open space 18 is substantially constant over the entire guidance distance D, and extends over the width of the drawing unit 1. Here, the size of the guidance width A is selected so as to enable a free unobstructed exit of the blowing stream generated by the drawing unit 1 at the blast opening 3. The natural course of the blowing stream is illustrated using the dash-dotted boundaries, which extend with increasing expansion from the blast opening 3 up to the deposit belt 6. The fiber strands 20 are guided inside this blowing stream. As the distance from the blast opening 3 increases, an increasing freedom of movement of the fiber strands thus results inside the blowing stream, which freedom of movement would lead to a deposit of the fiber strands with large deposit ellipses in their further course without any interruption.

The second section of the guidance distance C is a guidance channel 9, which is designed with a substantially narrower guidance width in relation to that of the open space 18. The guidance width of the guidance channel 9 is marked with the capital letter B. The length of the guidance channel 9 results from the difference between the overall guidance distance C and the length D of the open space 18. Here, the length D is selected such that a free mobility of the blowing stream is possible without restriction at least over 50% of the entire guidance distance, preferably over 60% of the entire guidance distance C. Thus, $D>0.5*C$.

The guidance channel 9 formed between the guidance elements 7.1 and 7.2 has a channel constriction 35, which brings about a restriction of the blowing stream. Preferably, the guidance width A of the open space 18 is at least 5 times larger than the channel constriction 35 having the guidance width B. Thus, $A>5*B$. It is thus possible to achieve the desired effects for restricting the blowing stream. It is of particular relevance to the guidance of the blowing stream inside the guidance channel 9 that a funnel-shaped entrance up to the channel constriction 35 is provided by a convergent channel opening 8. The repeat expansion of the guidance channel 9 immediately after the channel constriction 35 by a divergent channel output 36 allows for the uniform distribution of the fiber strands inside the blowing stream hitting the deposit belt. It has been seen that the deposits of the fiber strands thus generated resulted in a non-woven web, which exhibited high strengths in the machine direction and in the cross direction and a high degree of uniformity in the mass distribution. There is also constant strength, which has positive effects particularly in the case of non-woven webs having relatively small basis weights.

In the example embodiment shown in FIGS. 1 and 2, particularly good results were achieved in the deposition of the fiber strands and formation of non-woven webs for guidance distances, whose length C lies in the range of 100 mm to a maximum of about 700 mm. Here, in the lower region of the guidance distance, the channel constriction of the guidance channel is designed with a guidance width B in the range of 10 mm to maximum of about 200 mm. In contrast, the open space 18 is designed with a guidance width A in the range of 300 mm to about 1000 mm.

Figure 4:
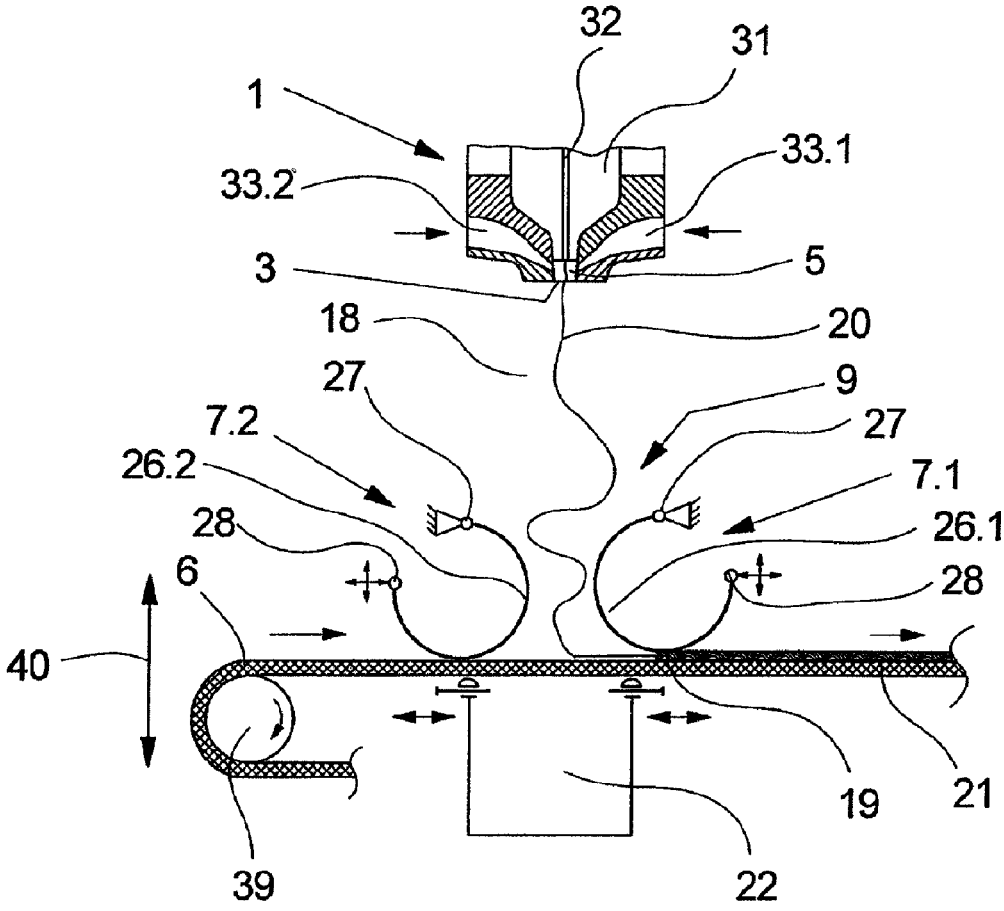
FIG. 4 schematically shows a cross-sectional view of second example embodiment of the apparatus according to the invention.

FIG. 4 schematically shows the cross-sectional view of another example embodiment of the apparatus disclosed herein for implementing the method disclosed herein. Unlike the afore-mentioned example embodiment, which is used for producing so-called spun-bond non-woven webs, the example embodiment shown in FIG. 4 is used for producing melt-blown non-woven webs.

In this embodiment, the drawing unit 1 is disposed immediately on a lower side of a spinneret 31. The spinneret 31 has a plurality of nozzle holes 32 disposed in a row-shaped arrangement transversely to a deposit belt 6. The nozzle hole 32 opens directly into a conveying channel 5, in which the blast nozzles 33.1 and 33.2 blow a blowing stream for drawing off the fiber strands extruded from the nozzle holes 32. The blowing stream exits together with the fiber strands from a blast opening 3 of the drawing unit 1 and is blown into an open space 18 designed directly below the drawing unit 1. The open space 18 is not shielded from the ambience so as to allow for a free flow of the blowing stream. The open space 18 thus has an unlimited guidance width, which is determined exclusively by the free ambience.

In the lower third of the guidance distance, the guidance channel 9 is arranged between the guidance elements 7.1 and 7.2 directly above the deposit belt 6. The shape of the guidance channel 9 is substantially identical to that shown in the example embodiment illustrated in FIGS. 1 and 2. Hence it requires no further explanation and one may refer to the previous description for the same.

In the present example embodiment, thin sheets 26.1 and 26.2 form the guidance elements. The thin sheets 26.1 and 26.2 are held opposite to one another, each of the thin sheets 26.1 and 26.2 including a clamping end 27 and a deformation end 28. The thin sheets 26.1 and 26.2 are held in a fixed manner on the clamping end 27. The thin sheets 26.1 and 26.2 have a circular curvature and are supported with one section at the end of the guidance channel 9 against the upper side of the deposit belt 6 or the upper side of the deposited non-woven web 21. Due to this, the guidance channel 9 in the deposit region is shielded from the ambience and an entrance of external air is prevented. The deformation ends 28 of the thin sheets 26.1 and 26.2 are designed outside the guidance channel 9. The position of the deformation ends 28 can be changed. Thus, the shapes of the thin sheets 26.1 and 26.2 can be deformed for changing the guidance channel 9, for example, for expanding the channel constriction.

The shape of the guidance channel 9 between the thin sheets 26.1 and 26.2 is identical to that of the preceding example embodiment. Hence one may refer to the previous description for this purpose.

On the lower side of the deposit belt 6, exhaust equipment 22 is arranged in the deposit region. The exhaust equipment 22 is substantially identical to that of the previous example embodiment. Therefore it requires no further explanation here The example embodiment shown in FIG. 4 represents an open system as opposed to the example embodiment shown in FIGS. 1 and 2. In the present embodiment, the open space 18 is connected directly to the ambience with the result that a free exchange can take place between the blowing stream and the ambience. Particularly when using heated fluid streams, as is often common practice in the case of melt-blown systems, it is thus possible to bring about additional cooling effects on the fiber strands.

At this point, it must be mentioned expressly that the guidance elements 7.1 and 7.2 in the example embodiment shown in FIG. 4 could be replaced by the rollers 12.1 and 12.2 shown in FIGS. 1 and 2 and vice versa. It is likewise possible to design the apparatus shown in FIGS. 1 and 2 as an open system having an open space.

In the example embodiment shown in FIG. 4, the guidance elements 7.1 and 7.2 and the deposit belt 6 are arranged on a lifting table (not illustrated here). A double arrow with the reference numeral 40 indicates the lifting table only symbolically. The guidance distance below the drawing unit 1 can thus be set by adjusting the height of the guidance elements 7.1 and 7.2 and of the deposit belt. Furthermore, the mobility and the deformability of the guidance elements 7.1 allows for an adjustment of the forming gap 19 formed between the guidance elements 7.1 and the deposit belt 6.

Figure 5:
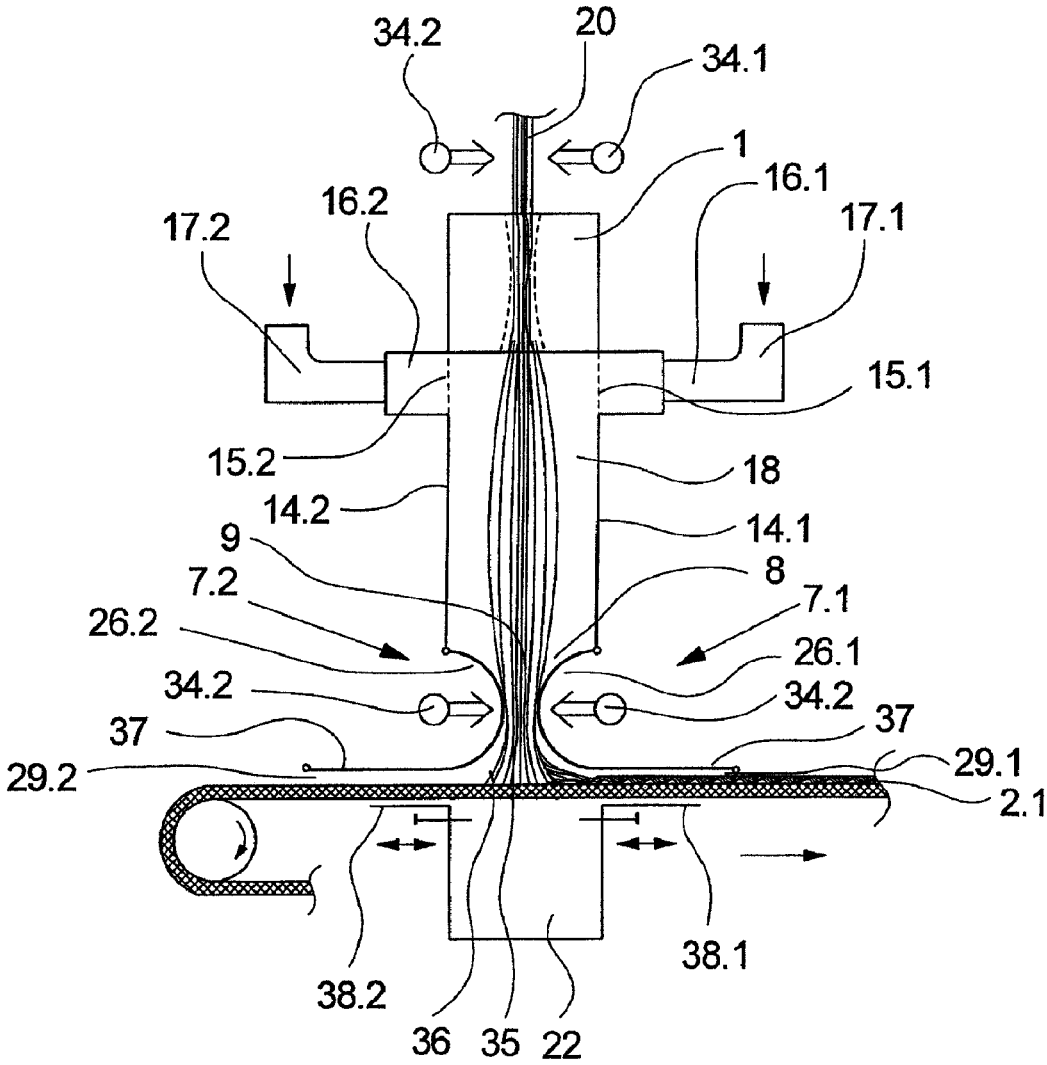
FIG. 5 schematically shows a cross-sectional view of a third example embodiment of the apparatus according to the invention.

FIG. 5 schematically shows the cross-section of another example embodiment of the apparatus according disclosed herein for implementing the method disclosed herein. The example embodiment shown in FIG. 5 is substantially identical to that shown in FIGS. 1 and 2. Hence only the differences are explained below and the previous description may be referred to in all other respects.

In the example embodiment shown in FIG. 5, the drawing unit 1 and the open space 18 are designed identically to that of the preceding example embodiment shown in FIGS. 1 and 2. For designing the guidance channel 9, the guidance elements 7.1 and 7.2 are formed by molded thin sheets 26.1 and 26.2. The shape of the guidance channel 9 is selected by way of the curvature of the thin sheets in such a manner that at the end of the open space, a convergent channel opening 8 opens out into a channel constriction 35. The channel constriction 35 gives way to an expansion, which leads to a divergent channel output 36. On the side facing the deposit belt 6, the thin sheets 26.1 and 26.2 each have oblong legs 37, which extend parallel to the deposit belt 6 and form a sealing gap 29.1 and 29.2 with the deposit belt 6 or with the non-woven web 21. The length of the sealing gap 29.1 and 29.2 is selected such that the deposit region is completely shielded inside the guidance channel 9 on the deposit belt 6.

Any frictional contact between the guidance elements 7.1 and 7.2 with the non-woven web 21 or the deposit belt 6 is thus prevented on the upper side of the deposit belt.

The exhaust equipment 22 provided on the lower side of the deposit belt likewise has oblong sealing lips 38.1 and 38.2 in order to prevent the entry of external air from the ambience.

In the example embodiment shown in FIG. 5, a charge inducer 34.1 is provided in front of the entrance of the drawing unit 1 and another charge inducer 34.2 is provided in the region of the guidance elements 7.1 and 7.2. The charge inducer 34.1 creates an electrostatic, preferably positive charge on the fiber strands 20. Likewise, the charge inducer 34.2 creates an electrostatic charge on the thin sheets 26.1 and 26.2. The charges of the fiber strands 20 and the charges of the guidance elements 7.1 and 7.2 are of like polarization. Thus by charging the fiber strands and the guidance elements, it is possible to optimize the entry and constriction of the blowing stream inside the guidance distance. The fiber strands move away from the contour of the guidance elements 7.1 and 7.2. Additionally, a negative charge could be created on the lower side of the deposit belt 6 with the result that an additional tractive force can be generated on the depositing fiber strands. It is thus possible to create additional effects when depositing the fiber strands to form a non-woven web.

The structure and arrangement of the components of the example embodiments, shown in FIG. 1 to FIG. 5, of the apparatus according to the invention for implementing the method according to the invention are illustrated by way of example only. It is important that for depositing the fibers on the deposit belt, the fibers are initially guided in an open space in order to then meet the deposit belt after a constriction of the blowing stream in a closed deposit region. In doing so, those guidance elements are particularly suitable, which allows for a stable and reproducible guidance and deposition of the fiber strands.

While various embodiments of the invention have been particularly shown and described, it will be understood by those skilled in the art that various changes in form and details may be made therein without departing from the spirit and scope of the invention as defined by the appended claims.

LIST OF REFERENCE NUMERALS

1 Drawing unit
2 Fiber entrance
3 Blast opening
4 Fluid connection
5 Conveying channel
6 Deposit belt
7.1, 7.2 Guidance element
8 Channel opening
9 Guidance channel
10 Belt discharge side
11 Belt supply side
12.1, 12.2 Roller
13 Roller jacket
14.1, 14.2 Separation wall
15.1, 15.2 Suction port
16.1, 16.2 Air intake channel
17.1, 17.2 Suction inlet
18 Open space
19 Forming gap
20 Fiber strands
21 Non-woven web
22 Exhaust equipment
23 Exhaust port
24.1, 24.2 Cover plate
25 Sealing element
26.1, 26.2 Thin sheet
27 Clamping end
28 Deformation end
29.1, 29.2 Sealing gap
30 Height adjusting device
31 Spinneret
32 Nozzle hole
33.1, 33.2 Blast nozzles
34.1, 34.2 Charge inducers
35 Channel constriction
36 Channel output
37.1, 37.2 Leg
38 Fluid inlet
39 Conveyor roller
40 Lifting table

The invention claimed is:

1. An apparatus for depositing a plurality of extruded synthetic fiber strands to form a non-woven web, the apparatus comprising:

a drawing unit having an elongated slot opening for receiving fiber strands in a row-shaped arrangement;

a deposit belt arranged below the drawing unit, the deposit belt being driven such that it is directed transversely to a longitudinal side of the drawing unit; and a plurality of guidance elements provided in a guidance distance between a blast opening of the drawing unit and the deposit belt, one of the guidance elements being arranged on a belt discharge side, and an opposite guidance element being arranged on a belt supply side above the deposit belt to form a guidance channel constructed and arranged to guide the fiber strands for deposition on the deposit belt, the guidance elements forming a channel opening of the guidance channel at a distance from the blast opening of the drawing unit, wherein the distance between the blast opening of the drawing unit and the channel opening of the guidance channel is larger than half the guidance distance, and wherein a guidance width of an open space formed between the blast opening of the drawing unit and the channel opening of the guidance channel is larger than that of the guidance channel.

2. The apparatus according to claim 1, wherein the channel opening of the guidance channel is constructed and arranged convergently by the guidance elements, wherein the channel opening opens out into a channel constriction of the guidance channel.

3. The apparatus according to claim 2, wherein the guidance width of the open space is at least five times larger than the guidance width of the channel constriction of the guidance channel.

4. The apparatus according to claim 3, wherein the guidance width of the channel constriction of the guidance channel is in the range of 10 mm to 200 mm, and wherein the guidance channel has a divergent channel output towards the deposit belt.

5. The apparatus according to claim 3, wherein the guidance distance between the blast opening of the drawing unit and the deposit belt has a length in the range of 100 mm to 700 mm.

6. The apparatus according to claim 1, wherein the open space on the belt supply side and on the belt discharge side is shielded from ambient air by walls.

7. The apparatus according to claim 6, wherein the wall comprise a plurality of suction ports disposed below the blast opening of the drawing unit constructed and arranged to suction ambient air.

8. The apparatus according to claim 7, wherein a single air intake channel is assigned to each the suction ports, each air intake channel including on one end a suction inlet having an inlet opening positioned in a direction away from the deposit belt.

9. The apparatus according to claim 1, wherein the guidance elements on the belt supply side and on the belt discharge side are each formed by a molded thin sheet, and wherein the thin sheets work together with the deposit belt and the non-woven web to seal the guidance channel during operation.

10. The apparatus according to claim 1, further comprising an oblong sealing gap disposed between one of the deposit belt or the non-woven web, and the guidance elements, the oblong sealing gap constructed and arranged to seal the guidance channel.

11. The apparatus according to claim 1, wherein the guidance elements disposed on the belt discharge side are formed by a pivoted roller, which forms a forming gap with the deposit belt of the non-woven web.

12. The apparatus according to claim 11, wherein the guidance elements disposed on the belt supply side are formed by a second pivoted roller, which is held so that it is in contact with one of the deposit belt or an incoming non-woven web.

13. The apparatus according to claim 12, wherein each of the rollers has a resilient roller jacket.

14. The apparatus according to claim 1, further comprising a height adjusting device operatively associated with the guidance elements, the height adjusting device being constructed and arranged to change the length of the guidance distance between the guidance elements and the deposit belt.

15. The apparatus according to claim 1, further comprising a height adjusting device operatively associated with the deposit belt, the height adjusting device being constructed and arranged to change the length a forming gap between the guidance elements and the deposit belt.

16. The apparatus according to claim 1, further comprising a constriction disposed between the guidance elements, wherein at least one of the guidance elements is held so that it is displaceable transversely to the drawing unit in order to selectively change the constriction of the guidance channel.

17. The apparatus according to claim 1, further comprising an adjustable exhaust port disposed below the deposit belt, the adjustable exhaust port constructed and arranged to connect an exhaust equipment to the lower side of the deposit belt.

18. The apparatus according to claim 1, further comprising a plurality of electrical charge inducers constructed and arranged to create an electrostatic charge on the fiber strands and on the guidance elements.

19. An apparatus for depositing synthetic fibers to form a non-woven web, the apparatus comprising:

a drawing unit having a deposit belt arranged below the drawing unit, the deposit belt being driven such that it is directed transversely to a longitudinal side of the drawing unit;

a plurality of guidance elements provided in a guidance distance between a blast opening of the drawing unit and the deposit belt, one of the guidance elements being arranged on a belt discharge side, and an opposite guidance element being arranged on a belt supply side above the deposit belt to form a guidance channel constructed and arranged to guide the fibers for deposition on the deposit belt, the guidance elements forming a channel opening of the guidance channel at a distance from the blast opening of the drawing unit; and wherein the distance between the blast opening of the drawing unit and the channel opening of the guidance channel is larger than half the guidance distance, and wherein a guidance width of an open space formed between the blast opening of the drawing unit and the channel opening of the guidance channel is larger than that of the guidance channel;

wherein the guidance elements on the belt supply side and on the belt discharge side are each formed by a molded thin sheet, and wherein the thin sheets work together with the deposit belt and the non-woven web to seal the guidance channel during operation; and wherein the molded thin sheets include a clamping end in the region of the channel opening and a deformation end in the region outside the guidance channel, wherein the shape of the respective thin sheet can be changed by moving the deformation end relative to the clamping end.

* * * * *